US009662696B2

(12) United States Patent
Pichler

(10) Patent No.: US 9,662,696 B2
(45) Date of Patent: May 30, 2017

(54) METHOD FOR PRODUCING A GUN BARREL WITH INTEGRALLY ADJOINING HOUSING

(71) Applicant: STEYR MANNLICHER GMBH, Kleinraming (AT)

(72) Inventor: Harald Pichler, Gaflenz (AT)

(73) Assignee: Steyr Mannlicher GmbH, Kleinraming (AT)

( * ) Notice: Subject to any disclaimer, the term of this patent is extended or adjusted under 35 U.S.C. 154(b) by 0 days.

(21) Appl. No.: 14/770,493

(22) PCT Filed: Mar. 6, 2014

(86) PCT No.: PCT/AT2014/050053
§ 371 (c)(1),
(2) Date: Aug. 26, 2015

(87) PCT Pub. No.: WO2014/134651
PCT Pub. Date: Sep. 12, 2014

(65) Prior Publication Data

US 2016/0030989 A1 Feb. 4, 2016

(30) Foreign Application Priority Data

Mar. 7, 2013 (AT) ..... A 50156/2013

(51) Int. Cl.
*B21C 37/15* (2006.01)
*B21K 1/06* (2006.01)
(Continued)

(52) U.S. Cl.
CPC ..... *B21C 37/152* (2013.01); *B21C 37/153* (2013.01); *B21K 1/066* (2013.01);
(Continued)

(58) Field of Classification Search
CPC ..... F41A 21/16; F41A 21/18; F41A 21/20; F41A 21/02; B21C 37/152; B21C 37/153;
(Continued)

(56) References Cited

U.S. PATENT DOCUMENTS 2,094,156 A * 9/1937 Johnson, Jr. ..... F41A 3/26 42/75.01
3,177,688 A * 4/1965 Kralowetz ..... B21C 37/153 42/76.1
(Continued)

FOREIGN PATENT DOCUMENTS

DE 768149 7/1958
DE 768149 C * 7/1958 ..... B21C 37/153
(Continued)

OTHER PUBLICATIONS

Austrian Office Action for 1A A 50156/2013 dated Mar. 7, 2013.
(Continued)

*Primary Examiner* — John D Cooper
(74) *Attorney, Agent, or Firm* — Hoffmann & Baron, LLP

(57) ABSTRACT

A method for producing a gun barrel with an integrally adjoining housing for at least one breech head includes the steps of providing a cylindrical blank having a through-bore corresponding to the breech head diameter; hammering a first longitudinal portion of the blank on a part of a first hammering mandrel corresponding to the inner profile of the barrel while the first hammering mandrel is guided through the through-bore; and hammering a second longitudinal portion of the blank on a second hammering mandrel corresponding to the inner profile of the housing while the second hammering mandrel is inserted into the through-bore.

20 Claims, 4 Drawing Sheets

(51) Int. Cl.

| | |
|---|---|
| ***B21K 1/16*** | (2006.01) |
| ***F41A 21/18*** | (2006.01) |
| ***F41A 21/12*** | (2006.01) |
| *B21C 37/20* | (2006.01) |

(52) U.S. Cl.
CPC ..... *B21K 1/16* (2013.01); *F41A 21/12* (2013.01); *F41A 21/18* (2013.01); *B21C 37/207* (2013.01)

(58) Field of Classification Search
CPC ..... B21C 37/16; B21C 37/156; B21C 37/207; B21C 37/20
USPC ..... 42/76.1, 76.01, 76.02, 78, 51
See application file for complete search history.

(56) References Cited

U.S. PATENT DOCUMENTS

| | | | | |
|---|---|---|---|---|
| 7,726,058 | B2 * | 6/2010 | Richards | F41C 9/08 42/51 |
| 7,877,919 | B2 * | 2/2011 | Richards | F41A 3/22 42/51 |
| 2010/0269682 | A1 * | 10/2010 | Vuksanovich | F41A 3/26 89/191.01 |
| 2011/0010976 | A1 * | 1/2011 | Lippard | B23D 77/14 42/2 |
| 2012/0137556 | A1 * | 6/2012 | Laney | F41C 23/16 42/6 |

FOREIGN PATENT DOCUMENTS

| | | |
|---|---|---|
| GB | 789861 | 1/1958 |
| GB | 979311 | 1/1965 |

OTHER PUBLICATIONS

International Preliminary Report on Patentability (in German) for PCT/AT2014/050053 dated Mar. 23, 2015.
International Preliminary Report on Patentability for PCT/AT2014/050053.

* cited by examiner

METHOD FOR PRODUCING A GUN BARREL WITH INTEGRALLY ADJOINING HOUSING

CROSS-REFERENCE TO RELATED APPLICATIONS

This application is a National Phase application of International Application No. PCT/AT2014/050053 filed Mar. 6, 2014 which claims priority to Austrian Patent Application No. A 50156/2013 filed Mar. 7, 2013, the disclosures of which are incorporated herein by reference.

BACKGROUND

The present invention relates to a method for producing a barrel with an integrally adjoining housing for a breech block head.

(Hunting) guns usually consist of the primary parts constituted by the barrel, housing, breech block, trigger device, magazine and shaft. The barrel is usually permanently connected to the housing by means of a screwed or shrink-fit connection. The locking faces necessary to securely lock the breech block are located either in the housing, an intermediate element (locking sleeve) or directly in the barrel. Due to the fact that a number of parts are provided, however, cumulative tolerances are produced, which have to be kept very low due to the legally stipulated (firing law) breech block distance. This entails an accurate, complex manufacture of the individual parts. The aforementioned connections between parts also determine the overall size of the housing and therefore the weapon weight.

Due to a one-part design of barrel and housing with integrated locking faces, the production can be simplified and a considerable reduction of the weapon weight can be achieved. Furthermore, the negative influencing of the vibration behaviour of the barrel by a (screwed) connection to the housing is fully eliminated.

Such a one-piece design of barrel and housing is known per se, see documents GB 643 842, GB 1 500 346 or DE 197 02 962, but requires complex and predominantly material-removing machining of the raw part, see US 2011/0010976 A1, for example.

SUMMARY

The object of the invention is to overcome the disadvantages of the known prior art and to create a method for producing a barrel with integrally adjoining housing, which enables a reduction of the production costs and at the same time an increase of the material strength.

This object is achieved with a method of the type mentioned in the introduction, having the following steps:

providing a cylindrical blank having a through-bore corresponding to the breech block head diameter;

hammering a first longitudinal portion of the blank on a part of a first hammering mandrel corresponding to the inner profile of the barrel whilst the first hammering mandrel is guided through the through-bore; and hammering a second longitudinal portion of the blank on a second hammering mandrel corresponding to the inner profile of the housing whilst the second hammering mandrel is inserted into the through-bore.

The hammering (cold forging) of a barrel blank on a hammering mandrel (forging mandrel) corresponding to the inner profile of the barrel is used worldwide in arms manufacturing for the production of barrels on account of the high precision that can be achieved and the economical manufacture. The hammering leads to an increase in strength of the basic material and to a considerable extension of the service life of the barrel. The invention uses the hammering for the first time to manufacture a housing adjoining the barrel integrally, such that the housing also experiences the strength increase of the cold forging process and additionally can be manufactured in a single process performed on the same hammering machine, without releasing the blank from the hammering machine. A separate material-removing manufacture of the housing or even screwed or shrink-fit connections to the barrel is/are eliminated; merely a few machining operations may be necessary in some embodiments of the method. When the housing is hammered immediately subsequently to the barrel, i.e. the blank is not removed in the meantime from the hammering machine, the housing is perfectly centred and aligned with respect to the barrel, with much lower tolerances than with the known screwed or shrink-fit connections.

In accordance with a first embodiment of the method the first hammering mandrel can be removed from the through-bore following the first hammering and the second hammering mandrel can then be introduced into the through-bore for the second hammering. Alternatively and particularly preferably, the first hammering mandrel is held using a holding rod during the first hammering, which holding rod is guided through a central bore of the second hammering mandrel. The second hammering mandrel therefore does not need to be removed during the hammering, i.e. the hammering can be performed continuously starting from the mouth of the barrel, over the barrel, to the housing.

For this purpose, it is also particularly favourable when the first hammering mandrel is retracted at least in part into the central bore of the second hammering mandrel for the second hammering, such that the first hammering mandrel (barrel hammering mandrel) is not in the way as the housing is hammered on the second hammering mandrel (housing hammering mandrel).

If the diameter transition between the first and the second hammering mandrel is large and does not allow the formation of a sharp inner shoulder between the housing interior and barrel bore or cartridge chamber during hammering, the through-bore may additionally be machined in the transition region between first and second longitudinal portion following the first or following the second hammering. This may additionally be used to produce an undercut for locking the breech block head in the housing.

Further, following the first or following the second hammering, the breech-side end region of the first longitudinal portion can be machined to form a cartridge chamber. Alternatively and particularly preferably, the cartridge chamber is also hammered at the same time, more specifically in that the breech-side end region of the first longitudinal portion is hammered, following the first hammering and prior to the second hammering, on a part of the first hammering mandrel shaping a cartridge chamber.

The second hammering is preferably carried out in a direction proceeding from the first longitudinal portion so as not to interrupt the continuity of the hammering process from the mouth of the barrel.

In a second aspect the invention creates a hammering mandrel arrangement for carrying out the presented method, comprising a first hammering mandrel, which has a circumferential part corresponding to the inner profile of the barrel and at one end is secured to a holding rod of reduced diameter, and a second hammering mandrel, which has a circumferential part corresponding to the inner profile of the housing and is provided with a central bore, wherein the holding rod is guided in the central bore of the second hammering mandrel.

With the aid of the hammering mandrel arrangement of the invention, the housing can be hammered in a single hammering process directly with the barrel hammering, which not only simplifies the manufacture significantly, but also decisively increases the precision of the integral arrangement formed from the housing and barrel.

The first hammering mandrel preferably can be introduced at least in part into the central bore of the second hammering mandrel in order to facilitate the removal of the hammering mandrel arrangement from the through-bore following the second hammering.

The hammering mandrel arrangement is preferably also configured to hammer the cartridge chamber of the barrel at the same time, in that the first hammering mandrel has a first part corresponding to the inner profile of the barrel and a second adjoining part corresponding to the cartridge chamber.

In accordance with a further preferred embodiment of the invention, the second hammering mandrel has longitudinal flutes. In conjunction with a finishing milling of an undercut in the breech housing, a type of bayonet groove is thus produced in the breech housing, in which groove a breech head provided with radial projections is introduced and can be locked by rotation (rotary piston closure).

BRIEF DESCRIPTION OF THE DRAWINGS

The invention will be explained in greater detail hereinafter on the basis of exemplary embodiments illustrated in the accompanying drawings, in which.

DETAILED DESCRIPTION

Figure 1:
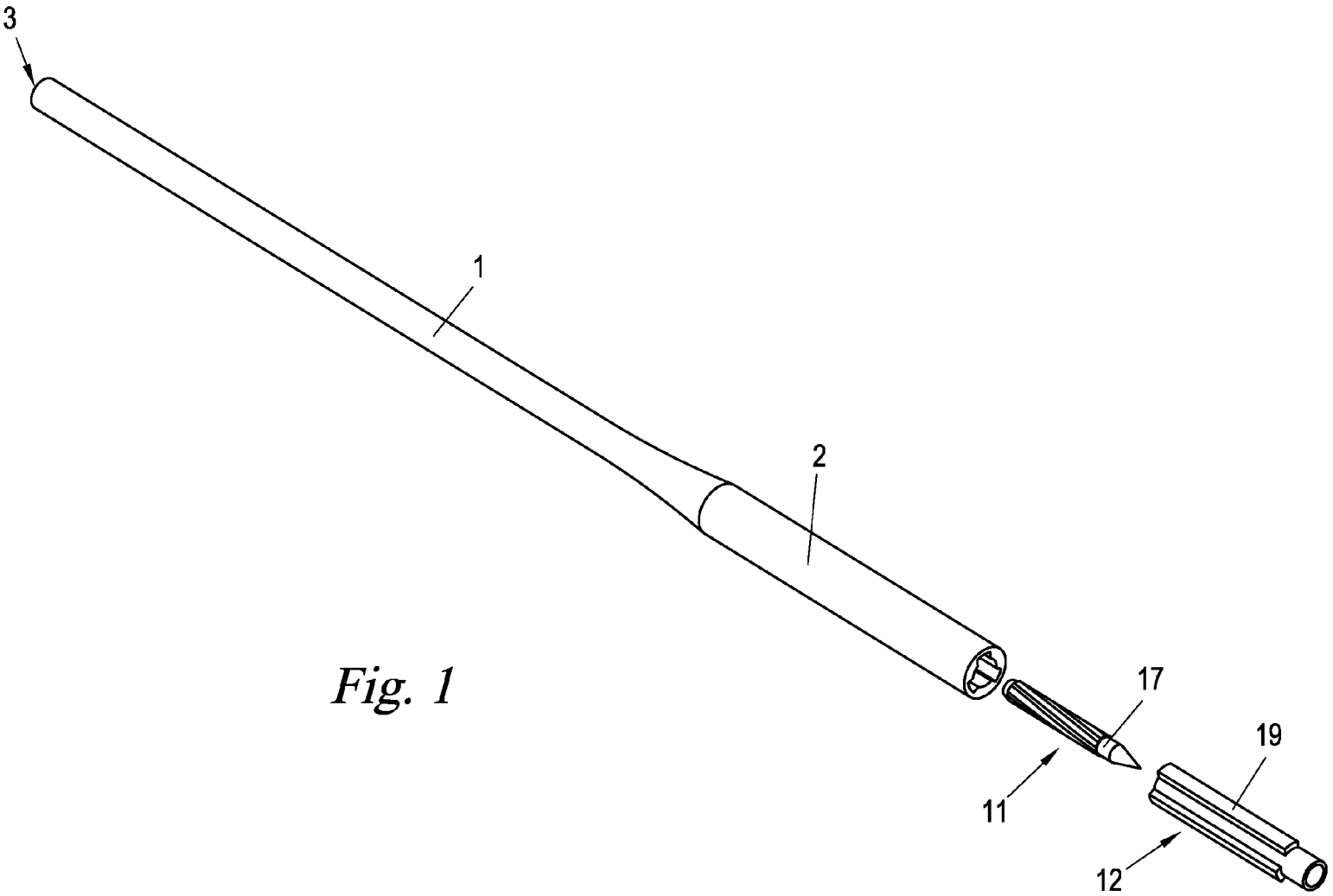
FIG. 1 shows a perspective view of a barrel with an integral housing in conjunction with a hammering mandrel arrangement.
Figure 2A:
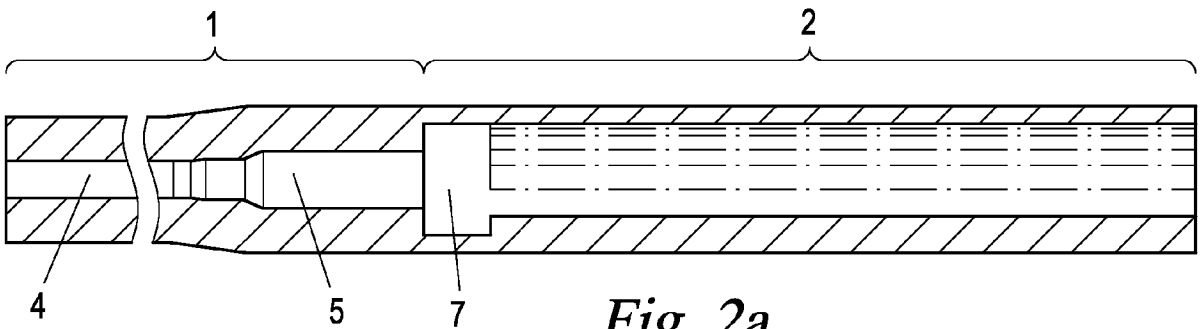
FIGS. 2*a* and 2*b* show a longitudinal section (FIG. 2*a*) and an end view from behind (FIG. 2*b*) of the barrel with integral housing from FIG. 1.
Figure 2B:
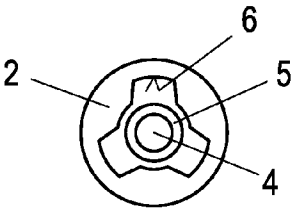

FIGS. 1, 2*a* and 2*b* show a barrel 1 for a firearm, for example a gun, which is adjoined integrally by a housing 2 for further components of the weapon. The barrel 1, as is known per se, has a mouth 3 and a barrel bore 4, of which the rear end portion facing away from the mouth 3 is widened to form a cartridge chamber 5.

The housing 2 accommodates a breech block or breech block head for the barrel 1, for example a rotary piston closure (not shown), which is introduced with ring gear-like radial extensions into axial inner flutes 6 of the housing 2 and in the fully inserted position closing the cartridge chamber 5 latches in an undercut 7 in a bayonet-like manner by rotation of its extensions in relation to the flutes 6.

The further components for operation of the breech block, for loading and unloading the cartridge, for triggering the striking device (firing pin) in the breech block, etc. are not shown for the sake of clarity; it goes without saying that the housing 2 for this purpose may have corresponding apertures, in particular on the underside thereof, for the passage of a magazine shaft and a trigger device, as is known in the art. Any end-face terminations of the housing 2 on the rear face thereof, for example covers and guides for the rotary piston closure exiting rearwardly during movement thereof, also are not illustrated in greater detail. The housing 2 considered here and joined integrally to the barrel 1 can be considered in this sense also as a semifinished housing part that can be supplemented or modified by further housing components.

The barrel 1 together with the housing 2 is manufactured in a barrel hammering machine by hammering (cold forging) on a hammering mandrel arrangement 10, comprising a first hammering mandrel 11 for the barrel 1 and a second hammering mandrel 12 for the housing 2, as will be explained in greater detail subsequently with reference to FIGS. 4 and 5. In accordance with FIGS. 3*a* and 3*b*, the first (barrel) hammering mandrel 11 is composed of a first part 13 corresponding to the inner profile of the barrel 1 and an adjoining second part 14 corresponding to the inner profile of the cartridge chamber 5. The barrel hammering mandrel 11 is held at the rear end thereof by a holding rod 15 during the hammering.

The barrel inner profile part 13 of the barrel hammering mandrel 11 may be provided (as is known to a person skilled in the art) on the outer side thereof with spiralled webs or grooves 16 in order to shape riflings or tracks in the barrel 1. Both the barrel inner profile part 13 and the cartridge chamber part 14 of the barrel hammering mandrel 11 are each slightly conically, more specifically slightly widened toward the rear, in order to avoid a "packing" of the barrel hammering mandrel 11 during the relative movement of the barrel hammering mandrel 11 through the barrel 1.

The housing hammering mandrel 12 of the hammering mandrel arrangement 10, said mandrel shaping the inner profile of the housing 2, may be a component fully separate from the barrel hammering mandrel 11 or, as illustrated here, may be penetrated by the holding rod 15 of the barrel hammering mandrel 11, i.e. this is guided in a sliding manner in a central bore 16 of the housing hammering mandrel 12.

As shown in FIG. 1, the barrel hammering mandrel 11 may also consist merely of the first part 13 for forming the inner profile of the barrel, i.e. the cartridge chamber part 14 may be omitted. Further, the barrel hammering mandrel 11 may be equipped at the rear end thereof (whether on the first part 13 or on the second part 14 when this is provided) with a tapered heel 17, which can be introduced into the central bore 16 of the housing hammering mandrel 12 in order to telescopically drive the barrel hammering mandrel 11 partially into the housing hammering mandrel 12 and in so doing to leave a defined overhang of the barrel hammering mandrel 11 beyond the end face of the housing hammering mandrel 12. If desired, the barrel hammering mandrel 11 may also be driven telescopically completely into the housing hammering mandrel 12 or may even be passed therethrough and removed from the housing hammering mandrel 12 toward the rear.

The housing hammering mandrel 12 is provided on the outer circumference thereof with longitudinal flutes 18 and longitudinal webs 19 remaining therebetween so as to thus shape the inner flutes 6 of the housing 2, which in cooperation with the undercut 7 serve to provide the bayonet locking of the breech block (breech block head).

Figure 4:
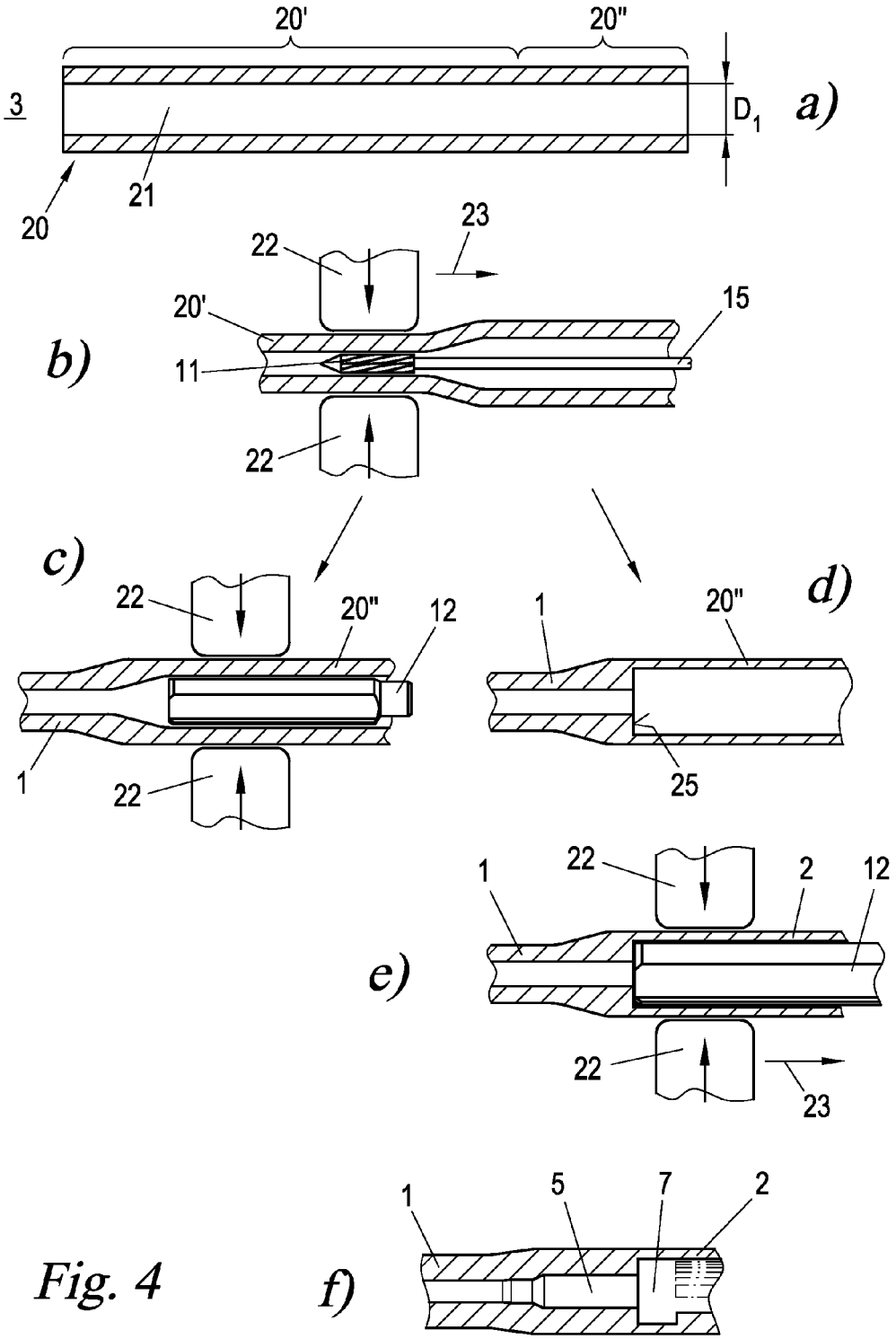
FIGS. 4 and 5 show different embodiments of the production method of the invention on the basis of partial longitudinal sections through the barrel with the housing and the hammering mandrel arrangement during successive phases of the method.

FIG. 4 shows a first embodiment of the method for producing the barrel 1 with the housing 2 with use of two separate barrel and housing hammering mandrels 11, 12. In a first step (FIG. 4*a*) a cylindrical blank 20 is provided having a through-bore 21 of which the inner diameter $D_1$ is at least as large as the maximum outer diameter of the breech or breech head to be received in the housing 2 and is therefore also at least as large as the maximum outer diameter of the housing hammering mandrel 12. The barrel 1 (possibly with the cartridge chamber 5) is forged from a first longitudinal portion 20' of the blank 20, and the housing 2 is forged from an adjoining second longitudinal portion 20", as will now be explained in detail.

The barrel hammering mandrel 11, held at the holding rod 15 thereof, is first introduced into the through-bore 21 of the blank 20 and is positioned (FIG. 4*b*) with the blank 20 between the forging hammers 22 of a barrel hammering machine (not illustrated further). As is known to a person skilled in the art, four forging hammers 22 are usually used around the circumference of the blank 20 and periodically and simultaneously hammer the blank 20 from the outside in order to forge the blank 20 onto the barrel hammering mandrel 11, whereas at the same time the hammers 22 and the hammering mandrel 11 are moved forward starting from the mouth 3 in the direction of the arrow 23 relative to the blank 20 (the hammers 22 and the mandrel 11 generally remain stationary and the blank 20 is moved against the direction of the arrow 23). The barrel hammering mandrel 11 is rotated here at the same time in order to leave behind, by means of its flutes 16, spiral riflings in the barrel bore 24 of the barrel 1 thus produced, as is known to a person skilled in the art.

When the barrel hammering mandrel 11 and the forging hammers 22 have reached the housing-side end region of the barrel portion 20", the cartridge chamber 5 can be further forged equally, in that the barrel hammering mandrel 11 is stopped in relation to the blank 20 and the cartridge chamber part 14 thereof thus takes effect (not illustrated). Alternatively, when the barrel hammering mandrel 11 has only the barrel inner profile part 13, the cartridge chamber 5 may be produced by a separate machining of the through-bore 21, for example by milling, and sometimes both at the same time as, or only following completion of all hammering steps.

Following removal of the barrel hammering mandrel 11, the housing hammering mandrel 12 is now introduced into the through-bore 20 and the housing 2 is hammered or forged thereon, see FIG. 4*c*.

The transition region between barrel 1 and housing 2 following the hammering of the barrel 1 and prior to the hammering of the housing 2 may optionally be machined, not only in order to mill the cartridge chamber 5 at the same time where applicable, but also in order to form a defined inner heel 25 in the through-bore 21 (FIG. 4*d*), which can be used as a reference and stop face for the second hammering mandrel 12 when hammering the housing 2 (FIG. 4*e*).

Following the hammering of the housing 2 on the housing hammering mandrel 12 (which again can be carried out progressively in the direction of the arrow 23 (FIG. 4*e*)), the housing hammering mandrel 12 is removed and the undercut 7 for the locking of the breech block head and of the cartridge chamber 5 (if not yet performed in the step of FIG. 4*c* or FIG. 4*d*) is produced by machining, for example milling (FIG. 4*f*). Further apertures, recesses or the like can then be milled into the housing 2 in order to finish this.

Figure 5:
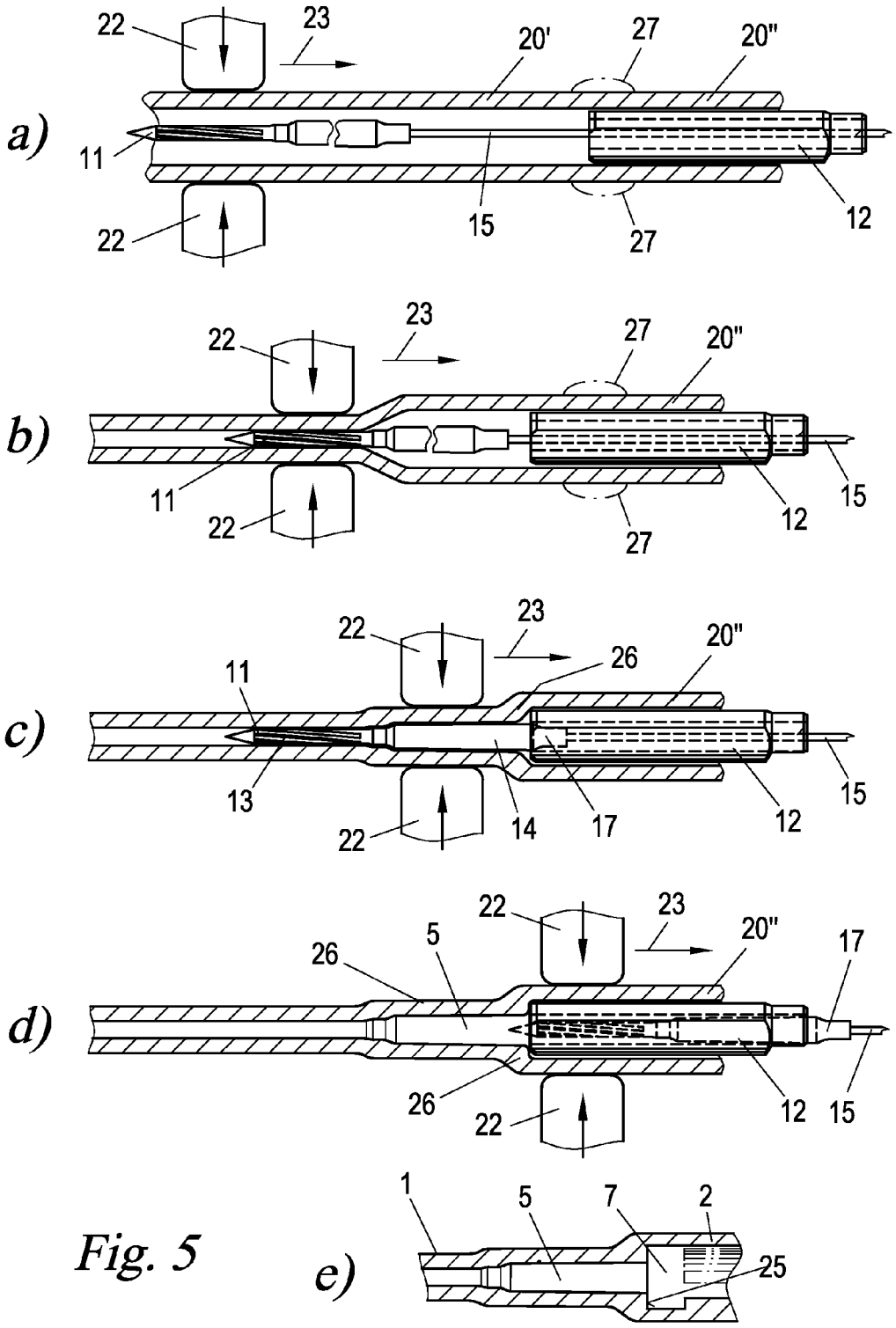

FIG. 5 shows a variant of the method from FIG. 4 in which a change of the hammering mandrels 11, 12 in the barrel hammering machine and the associated repositioning of the blank is not necessary and therefore all hammering steps for the barrel 1 and the housing 2 can be performed continuously in one go.

Figure 3A:
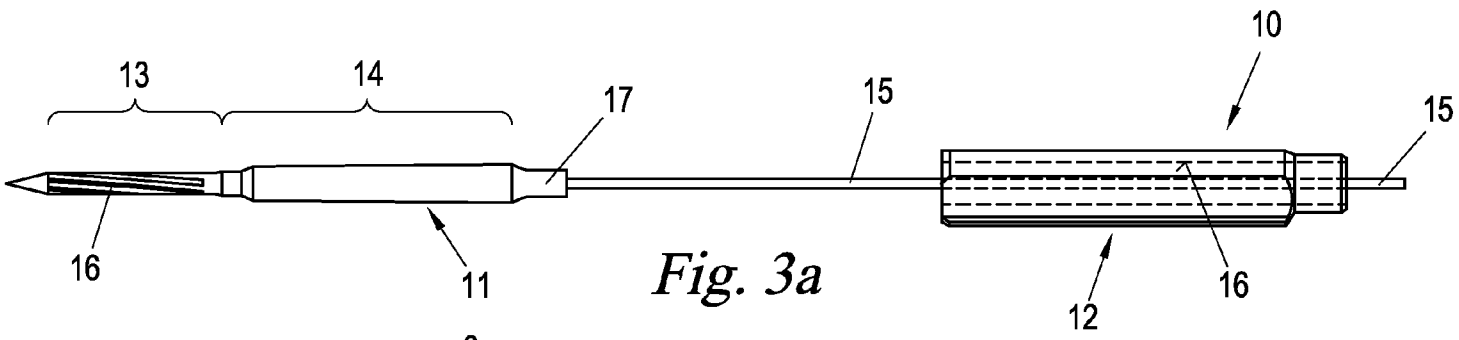
FIGS. 3*a* and 3*b* show a side view (FIG. 3*a*) and an end view from behind (FIG. 3*b*) of the hammering mandrel arrangement of the invention.
Figure 3B:
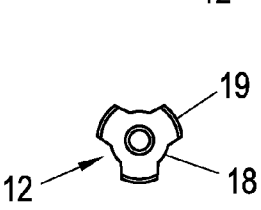

For this purpose the hammering mandrel arrangement 10 illustrated in FIGS. 3*a* and 3*b* is used, with which the holding rod 15 of the barrel hammering mandrel 11 is firstly guided through the bore 16 of the housing hammering mandrel 12 and in this arrangement both hammering mandrels 11, 12 are introduced into the blank 20 (FIG. 5*a*). During the hammering of the barrel 1 from the blank longitudinal portion 20', the barrel hammering mandrel 11 is moved forward continuously jointly with the forging hammers 22 in relation to the blank 20 in the direction of the arrow 23 (or the barrel 1 is moved against the arrow direction 23), wherein the holding rod 15 is passed through the housing hammering mandrel 12 (FIG. 5*b*).

When the forging hammers 22 reach the transition region between first blank longitudinal portion 20' and second blank longitudinal portion 20", the barrel hammering mandrel 11 is driven at least in part into the bore 16 of the housing hammering mandrel 12, i.e. at least via its tapered portion 17, in order to centre and axially align the entire hammering mandrel arrangement 10 formed of first and second hammering mandrel 11, 12 (FIG. 5*c*). If desired, following the hammering of the cartridge chamber, the cartridge chamber part 14 of the barrel hammering mandrel 11 can also be driven into the housing hammering mandrel 12, and optionally also the barrel inner profile part 13, i.e. the entire barrel hammering mandrel 11 (FIG. 5*d*).

In the event of a partial projecting position of the barrel hammering mandrel 11 in relation to the housing hammering mandrel 12, as is shown in FIG. 5*c*, the flow of the blank material during the hammering (cold forging) into the region 26 around the heel between the two hammering mandrels 11, 12 can be assisted by using a blank 20 that at this point has additional material 27 on its outer circumference, for example a circumferential bead. Alternatively or additionally, this region 26, following the removal of the entire hammering mandrel arrangement 10 from the through-bore 21 of the blank 20, may also be machined again in order to form the undercut 7 and the defined inner heel 25 and where appropriate to also mill the cartridge chamber 5 when this was not also forged (FIG. 5*e*).

The invention is not limited to the presented embodiments, but also includes all variants and modifications that fall within the scope of the accompanying claims.

What is claimed is:

1. A method for producing a barrel with an integrally adjoining housing comprising the steps of:

providing a cylindrical blank adapted to form the barrel and housing, the housing configured to receive a breech block, the blank including a through-bore with an inner diameter at least as large as a maximum outer diameter of the breech block;

hammering a first longitudinal portion of the blank on a part of a first hammering mandrel corresponding to an inner profile of the barrel whilst the first hammering mandrel is guided through the through-bore; and hammering a second longitudinal portion of the blank on a second hammering mandrel corresponding to an inner profile of the housing configured to receive the breech block whilst the second hammering mandrel is inserted into the through-bore.

2. The method according to claim 1, wherein the first hammering mandrel is removed from the through-bore following the hammering of the first longitudinal portion of the blank and the second hammering mandrel is then introduced into the through-bore for hammering the second longitudinal portion of the blank.

3. The method according to claim 1, wherein the first hammering mandrel is held using a holding rod during the hammering of the first longitudinal portion of the blank, which holding rod is guided through a central bore of the second hammering mandrel.

4. The method according to claim 3, wherein the first hammering mandrel is retracted for the hammering of the second longitudinal portion at least in part into the central bore of the second hammering mandrel.

5. The method according to claim 1, wherein the through-bore, following hammering the first or second longitudinal portion of the blank, is machined in a transition region between the first and second longitudinal portion.

6. The method according to claim 1, wherein following hammering the first or second longitudinal portion of the blank, a breech-side end region of the first longitudinal portion is machined to form a cartridge chamber.

7. The method according to claim 1, wherein following hammering the first longitudinal portion of the blank and prior to hammering the second longitudinal portion of the blank, a breech-side end region of the first longitudinal portion is hammered on a part of the first hammering mandrel shaping a cartridge chamber.

8. The method according to claim 1, wherein hammering the second longitudinal portion of the blank is performed in a direction starting from the first longitudinal portion.

9. The method according to claim 1, wherein the hammering mandrel comprises the first hammering mandrel, which has a circumferential part corresponding to the inner profile of the barrel and at one end is secured to a holding rod of reduced diameter, and the second hammering mandrel, which has a circumferential part corresponding to the inner profile of the housing and is provided with a central bore, wherein the holding rod is guided in the central bore of the second hammering mandrel.

10. The method according to claim 9, wherein the first hammering mandrel can be driven at least in part into the central bore of the second hammering mandrel.

11. The method according to claim 9, wherein the first hammering mandrel has a first part corresponding to the inner profile of the barrel and an adjoining second part corresponding to the cartridge chamber.

12. The method according to claim 9, wherein the second hammering mandrel has longitudinal flutes.

13. A method for producing a barrel with an integrally adjoining housing comprising the steps of:

providing a cylindrical blank adapted to form the barrel and housing, the housing configured to receive a breech block, the blank including a through-bore with an inner diameter at least as large as a maximum outer diameter of the breech block;

first hammering a first longitudinal portion of the blank on a part of a first hammering mandrel corresponding to the inner profile of the barrel whilst the first hammering mandrel is guided through the through-bore, whereafter a breech-side end region of the first longitudinal portion is hammered on a part of the first hammering mandrel shaping a cartridge chamber; and second hammering a second longitudinal portion of the blank on a second hammering mandrel corresponding to an inner profile of the housing whilst the second hammering mandrel is inserted into the through-bore.

14. The method according to claim 13, wherein the first hammering mandrel is removed from the through-bore following the first hammering and the second hammering mandrel is then introduced into the through-bore for the second hammering.

15. The method according to claim 13, wherein the first hammering mandrel is held using a holding rod during the first hammering, which holding rod is guided through a central bore of the second hammering mandrel.

16. The method according to claim 15, wherein the first hammering mandrel is retracted for the second hammering at least in part into the central bore of the second hammering mandrel.

17. The method according to claim 13, wherein the second hammering is performed in a direction starting from the first longitudinal portion.

18. A hammering mandrel arrangement for producing a barrel with an integrally adjoining housing which is configured to receive a breech block, comprising:

a first hammering mandrel having a first part corresponding to the inner profile of the barrel and a second part adjoining the first part, the second part corresponding to the inner profile of a cartridge chamber, the first hammering mandrel further including a holding rod of reduced diameter secured to one end thereof, and a second hammering mandrel, which has a circumferential part having an outer diameter corresponding to an inner profile of the housing configured to receive the breech block therein and wherein the second hammering mandrel is provided with a central bore, wherein the holding rod is movably guided through the central bore of the second hammering mandrel.

19. The hammering mandrel arrangement according to claim 18, wherein the first hammering mandrel can be driven at least in part into the central bore of the second hammering mandrel.

20. The hammering mandrel arrangement according to claim 18, wherein the second hammering mandrel has longitudinal flutes.

* * * * *